US011638941B2

(12) United States Patent
Shafiei et al.

(10) Patent No.: US 11,638,941 B2
(45) Date of Patent: May 2, 2023

(54) SYSTEMS AND METHODS FOR CONTROLLING FLATNESS OF A METAL SUBSTRATE WITH LOW PRESSURE ROLLING

(71) Applicant: Novelis Inc., Atlanta, GA (US)

(72) Inventors: Mehdi Shafiei, Farmington Hills, MI (US); David Anthony Gaensbauer, Atlanta, GA (US); Jeffrey Edward Geho, Marietta, GA (US); Andrew James Hobbis, Bath (CA); Steven L. Mick, Fairmont, WV (US)

(73) Assignee: Novelis Inc., Atlanta, GA (US)

( * ) Notice: Subject to any disclaimer, the term of this patent is extended or adjusted under 35 U.S.C. 154(b) by 261 days.

(21) Appl. No.: 16/041,288

(22) Filed: Jul. 20, 2018

(65) Prior Publication Data

US 2019/0022724 A1 Jan. 24, 2019

Related U.S. Application Data

(60) Provisional application No. 62/551,292, filed on Aug. 29, 2017, provisional application No. 62/551,296,
(Continued)

(51) Int. Cl.
*B21B 1/22* (2006.01)
*B21B 37/30* (2006.01)
(Continued)

(52) U.S. Cl.
CPC ..... *B21B 1/227* (2013.01); *B21B 31/20* (2013.01); *B21B 37/28* (2013.01); *B21B 37/30* (2013.01);
(Continued)

(58) Field of Classification Search
CPC ..... B21B 37/28; B21B 37/38; B21B 38/02; B21B 2263/04–08; B21B 13/147;
(Continued)

(56) References Cited

U.S. PATENT DOCUMENTS 1,106,172 A 8/1914 Wetcke
3,619,881 A 11/1971 Bills et al.
(Continued)

FOREIGN PATENT DOCUMENTS

CN 1230475 A 10/1999
CN 201033332 Y 3/2008
(Continued)

OTHER PUBLICATIONS

International Patent Application No. PCT/US2018/043049 , "International Preliminary Report on Patentability", dated Jan. 30, 2020, 10 pages.
(Continued)

*Primary Examiner* — Shelley M Self
*Assistant Examiner* — Teresa A Guthrie
(74) *Attorney, Agent, or Firm* — Kilpatrick Townsend & Stockton LLP

(57) ABSTRACT

A flatness control system includes a work stand of a finishing line, a plurality of actuators, a flatness measuring device, and a controller. The work stand includes a pair of vertically aligned work rolls. A first work roll of the pair of work rolls includes a plurality of flatness control zones configured to apply a localized pressure to a corresponding region on a substrate. Each actuator corresponds with a one of the plurality of flatness control zones. The flatness measuring device is configured to measure an actual flatness profile of the substrate. The controller is configured to adjust the plurality of actuators such that the localized pressures modify the actual flatness profile to achieve the desired
(Continued)

flatness profile at the exit of the stand. The thickness and a length of the substrate remain substantially constant when the substrate exits the work stand.

19 Claims, 9 Drawing Sheets

Related U.S. Application Data filed on Aug. 29, 2017, provisional application No. 62/551,298, filed on Aug. 29, 2017, provisional application No. 62/535,349, filed on Jul. 21, 2017, provisional application No. 62/535,341, filed on Jul. 21, 2017, provisional application No. 62/535,345, filed on Jul. 21, 2017.

(51) Int. Cl.

| | |
|---|---|
| ***B21B 37/28*** | (2006.01) |
| ***B21B 31/20*** | (2006.01) |
| ***B21B 38/00*** | (2006.01) |
| ***B21B 37/58*** | (2006.01) |
| ***B21B 13/14*** | (2006.01) |
| ***B21B 3/00*** | (2006.01) |
| ***B21B 29/00*** | (2006.01) |
| ***B21H 8/00*** | (2006.01) |

(52) U.S. Cl.

CPC ..... *B21B 13/14* (2013.01); *B21B 13/147* (2013.01); *B21B 29/00* (2013.01); *B21B 37/58* (2013.01); *B21B 38/00* (2013.01); *B21B 2001/228* (2013.01); *B21B 2003/001* (2013.01); *B21B 2261/14* (2013.01); *B21B 2265/12* (2013.01); *B21B 2267/10* (2013.01); *B21H 8/005* (2013.01)

(58) Field of Classification Search

CPC ..... B21B 13/14; B21B 29/00; B21B 31/20; B21B 31/22–32; B21B 1/227; B21B 37/30; B21B 37/58; B21B 38/00; B21B 2001/228; B21B 2003/001; B21B 2261/14; B21B 2265/12; B21B 2267/10; B21B 37/02; B21B 37/00; B21B 2267/18; B21B 2269/08; B21H 8/005

USPC ..... 72/12.8, 11.7, 9.1, 241.4; 700/154

See application file for complete search history.

(56) References Cited

U.S. PATENT DOCUMENTS

| | | | | |
|---|---|---|---|---|
| 4,017,367 | A | 4/1977 | Saunders | |
| 4,978,583 | A | 12/1990 | Wakui et al. | |
| 5,025,547 | A | 6/1991 | Sheu et al. | |
| 5,508,119 | A | 4/1996 | Sheu et al. | |
| 5,666,844 | A | 9/1997 | Bieber | |
| 5,692,407 | A * | 12/1997 | Kajiwara | B21B 37/38 72/13.6 |
| 5,904,204 | A | 5/1999 | Teraoka et al. | |
| 6,868,707 | B2 | 3/2005 | Nishi et al. | |
| 7,353,681 | B2 * | 4/2008 | Ball | B21B 1/227 492/30 |
| 7,516,637 | B2 | 4/2009 | Scamans et al. | |
| 7,624,609 | B2 | 12/2009 | Ball et al. | |
| 7,797,974 | B2 * | 9/2010 | Kruger | B21B 37/28 72/9.1 |
| 11,213,870 | B2 | 1/2022 | Shafiei et al. | |
| 11,426,777 | B2 | 8/2022 | Shafiei et al. | |
| 2003/0150587 | A1 | 8/2003 | Li et al. | |
| 2005/0115295 | A1 * | 6/2005 | Pont | B21B 1/227 72/252.5 |
| 2006/0123867 | A1 | 6/2006 | Ball et al. | |
| 2009/0004044 | A1 | 1/2009 | Sawada et al. | |
| 2010/0242559 | A1 | 9/2010 | Saenz de Miera | |
| 2010/0249973 | A1 * | 9/2010 | Bergsten | B21B 37/28 700/104 |
| 2012/0253502 | A1 | 10/2012 | Holm et al. | |
| 2012/0298183 | A1 | 11/2012 | Buresch et al. | |
| 2013/0273394 | A1 | 10/2013 | Sheu et al. | |
| 2016/0052032 | A1 * | 2/2016 | Moden | B21B 37/42 72/12.7 |
| 2016/0059283 | A1 | 3/2016 | Breuer et al. | |
| 2019/0022720 | A1 | 1/2019 | Shafiei et al. | |
| 2019/0022721 | A1 | 1/2019 | Shafiei et al. | |

FOREIGN PATENT DOCUMENTS

| | | | | |
|---|---|---|---|---|
| CN | 101288880 | A | 10/2008 | |
| CN | 202984272 | U | 6/2013 | |
| CN | 103949481 | A | 7/2014 | |
| CN | 104785541 | A | 7/2015 | |
| CN | 104870111 | A | 8/2015 | |
| CN | 106903170 | A | 6/2017 | |
| DE | 102007028823 | | 12/2008 | |
| EP | 1368140 | A1 | 12/2003 | |
| EP | 1607150 | | 12/2005 | |
| EP | 1297903 | | 8/2006 | |
| EP | 1368140 | | 8/2006 | |
| EP | 2292341 | | 3/2011 | |
| EP | 2670540 | | 2/2016 | |
| GB | 191410850 | A | 7/1914 | |
| JP | S6286120 | A | 4/1987 | |
| JP | 63016804 | A * | 1/1988 | B21B 37/30 |
| JP | H03114601 | A | 5/1991 | |
| JP | H03169403 | A | 7/1991 | |
| JP | H03238108 | A | 10/1991 | |
| JP | H06171261 | A | 6/1994 | |
| JP | H0751701 | A | 2/1995 | |
| JP | H09225555 | A | 9/1997 | |
| JP | H10501470 | A | 2/1998 | |
| JP | 2006239744 | A | 9/2006 | |
| JP | 2007516841 | A | 6/2007 | |
| JP | 2010260074 | A | 11/2010 | |
| JP | 2012052290 | A | 3/2012 | |
| JP | 2012157899 | A | 8/2012 | |
| JP | 2012206170 | A | 10/2012 | |
| JP | 2013094820 | A | 5/2013 | |
| JP | 2015182107 | A | 10/2015 | |
| JP | 6171261 | | 7/2017 | |
| RU | 2158639 | C2 | 11/2000 | |
| RU | 2333811 | C2 | 9/2008 | |
| SU | 733754 | | 5/1980 | |
| SU | 931244 | A1 | 5/1982 | |
| WO | 2006002784 | | 1/2006 | |
| WO | 2016034658 | A1 | 3/2016 | |

OTHER PUBLICATIONS

PCT/US2018/043049 , "International Search Report and Written Opinion", dated Oct. 12, 2018, 13 pages.

Suzuki et al., "Strip Shape Control System of Mitsubishi CR Mill", Conference Record Of The IEEE Industry Applications Conference. 34th IAS Annual Meeting. Phoenix, AZ, Oct. 3, 1999, pp. 565-570.

Australian Pat. Appl. No. 2018302336 , First Examination Report dated Oct. 20, 2020, 4 pages.

Chinese Pat. Appl. No. 201880048599.2 , Office Action dated Nov. 5, 2020, 22 pages.

Japanese Patent Application No. 2020-502224, Office Action dated Jan. 19, 2021, 8 pages.

Indian Patent Application No. 202017002138 , First Examination Report dated Sep. 2, 2020, 6 pages.

Russian Patent Application No. 2020102535 , Office Action, dated Jul. 6, 2020, 16 pages.

Canadian Patent Application No. 3,069,981 , Office Action dated Apr. 9, 2021, 8 pages.

Australian Patent Application No. 2018302336 , Second Examination Report dated Mar. 1, 2021, 4 pages.

Korean Patent Application No. 10-2020-7004646 , Office Action dated Mar. 18, 2021, 17 pages.

(56) References Cited

OTHER PUBLICATIONS

Canadian Application No. 3,069,981, Office Action, dated Sep. 27, 2021, 7 pages.
Chinese Application No. 201880048599.2, Office Action, dated Sep. 7, 2021, 12 pages.
Korean Application No. 10-2020-7004646, Office Action, dated Aug. 23, 2021, 5 pages.
Chinese Application No. 201880048599.2, Office Action, dated May 27, 2021, 14 pages.
Application No. CN201880048599.2 , Office Action, dated Jan. 12, 2022, 15 pages.
Application No. CN201880048614.3 , Notice of Decision to Grant, dated Feb. 23, 2022, 6 pages.
U.S. Appl. No. 16/041,293 , Final Office Action, dated Nov. 23, 2021, 17 pages.
Application No. CA3,069,978 , Office Action, dated Jan. 11, 2022, 5 pages.
Application No. KR10-2020-7004644 , Notice of Decision to Grant, dated Oct. 21, 2021, 4 pages.
Application No. CA3,069,981 , Office Action, dated Jul. 26, 2022, 18 pages.
Application No. EP18756515.5 , Office Action, dated Feb. 22, 2022, 5 pages.
Brazilian Application No. BR112020001010-3, "Office Action", dated Sep. 13, 2022, 4 pages.
Korean Application No. 10-2021-7033316, "Notice of Decision to Grant", dated Oct. 4, 2022, 5 pages.
Korean Application No. 2021-7033316, "Office Action", dated Dec. 6, 2021, 3 pages.
European Application No. EP18756515.5, "Intension to Grant", dated Nov. 7, 2022, 8 pages.

* cited by examiner

SYSTEMS AND METHODS FOR CONTROLLING FLATNESS OF A METAL SUBSTRATE WITH LOW PRESSURE ROLLING

REFERENCE TO RELATED APPLICATIONS

This application claims the benefit of U.S. Provisional Application No. 62/535,345, filed on Jul. 21, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/535,341, filed on Jul. 21, 2017 and entitled MICRO-TEXTURED SURFACES VIA LOW PRESSURE ROLLING; U.S. Provisional Application No. 62/535,349, filed on Jul. 21, 2017 and entitled SYSTEMS AND METHODS FOR CONTROLLING FLATNESS OF A METAL SUBSTRATE WITH LOW PRESSURE ROLLING; U.S. Provisional Application No. 62/551,296, filed on Aug. 29, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/551,292, filed on Aug. 29, 2017 and entitled MICRO-TEXTURED SURFACES VIA LOW PRESSURE ROLLING; and U.S. Provisional Application No. 62/551,298, filed on Aug. 29, 2017 and entitled SYSTEMS AND METHODS FOR CONTROLLING FLATNESS OF A METAL SUBSTRATE WITH LOW PRESSURE ROLLING, all of which are hereby incorporated by reference in their entireties.

FIELD OF THE INVENTION

This application relates to control systems and methods for controlling flatness of a metal substrate with low pressure rolling in a finishing line.

BACKGROUND

Metal rolling can be used for forming metal strips (e.g., plates, sheets, foils, slabs, etc.) (hereinafter "metal substrates") from stock, such as ingots or thicker metal strips. An important characteristic of a metal substrate is the substrate's flatness, or the ability of the substrate to lay flat when placed on a level surface with no externally applied loads. Off-flatness, or deviations from flatness, is caused by internal stresses in the metal substrate, and may come in various forms such as edge waves, center waves, buckling, near-edge pockets, etc. Metal substrates with poor flatness are difficult to process at high speeds, may cause steering problems during processing, are difficult to trim and/or slit, and may be generally unsatisfactory for various customer or downstream processes. Currently, metal sheets are flattened during coil-to-coil finishing operations using tension-controlled sheet levelling set-ups. However, the equipment needed for tension-controlled sheet levelling generally prevents the finishing line from being compact.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Certain aspects and features of the present disclosure relate to a method of applying a texture on a substrate. In some examples, the substrate may be a metal substrate (e.g., a metal sheet or a metal alloy sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials.

In some aspects, the substrate is a metal substrate. Although the following description is provided with reference to the metal substrate, it will be appreciated that the description is applicable to various other types of metal or non-metal substrates. According to various examples, a method of controlling the flatness of a metal substrate includes directing a metal substrate to a work stand of a finishing line and between a pair of vertically aligned work rolls. The method includes applying, by a first work roll of the pair of work rolls, a plurality of localized work roll pressures to the metal substrate across a width of the metal substrate. Each localized work roll pressure is applied by a corresponding flatness control zone of the first work roll, and the work roll pressure applied by each flatness control zone is controlled by a corresponding actuator. The method includes measuring an actual flatness profile of the metal substrate with a flatness measuring device. In some examples, the method includes comparing, by a controller, the actual flatness profile with a desired flatness profile, and adjusting, by the controller, at least one of the actuators. The actuators are adjusted such that the localized work roll pressures modify the actual flatness profile to achieve the desired flatness profile and an overall thickness and a length of the metal substrate remain substantially constant when the metal substrate exits the work stand. Compared to conventional flatness control on a rolling mill, the disclosed method does not significantly change the overall nominal gauge of the strip during this operation, and only the localized areas that were under higher relative incoming tension are reduced very slightly. The localized thickness change required to correct flatness is a tiny fraction of a percentage of nominal thickness, typically less than 0.2%, and is less than the thickness change imparted by typical tension leveling operations.

According to various examples, a flatness control system includes a work stand of a finishing line, a plurality of actuators, a flatness measuring device, and a controller. The work stand includes a pair of vertically aligned work rolls. A first work roll of the pair of work rolls includes a plurality of flatness control zones across a width of the first work roll, and each flatness control zone is configured to apply a localized work roll pressure to a corresponding region on a metal substrate. Each actuator of the plurality of actuators corresponds with one of the plurality of flatness control zones and is configured to cause the corresponding flatness control zone to apply the localized work roll pressure. The flatness measuring device is configured to measure an actual flatness profile of the metal substrate. The controller is configured to adjust the plurality of actuators such that the localized work roll pressures modify the actual flatness profile to achieve the desired flatness profile while an overall thickness and a length of the metal substrate remain substantially constant when the metal substrate exits the work stand. As noted above, a difference between conventional flatness control on a rolling mill and the disclosed method is that the overall nominal gauge of the strip does not change significantly during this operation. Rather, only the localized areas that were under higher relative incoming tension are reduced very slightly. The localized thickness change required to correct flatness is a tiny fraction of a percentage of nominal thickness, typically less than 0.2%. This is less than the thickness change imparted by typical tension leveling operations.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
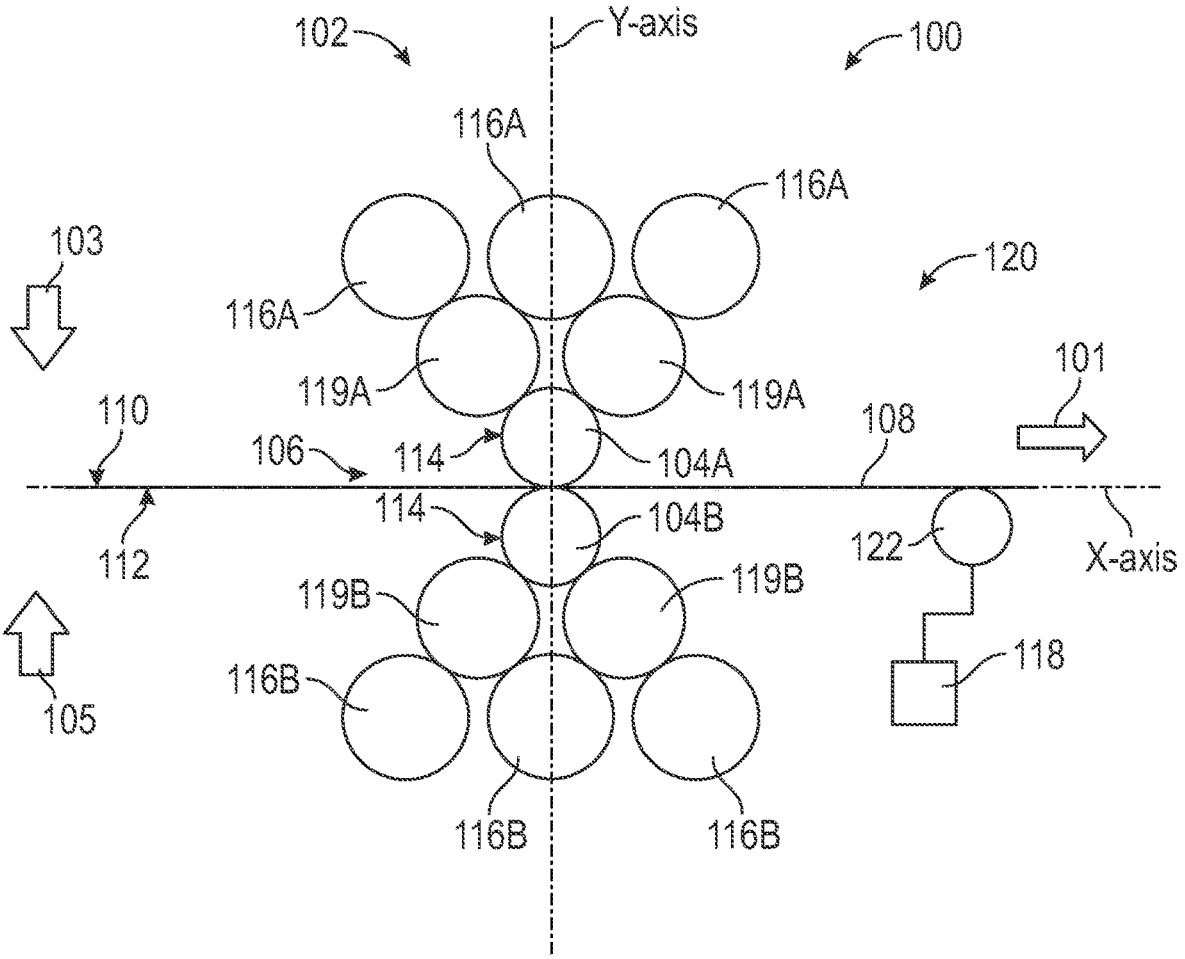
FIG. 1 is a schematic of a finishing line including a work stand and flatness control system according to aspects of the present disclosure.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain aspects and features of the present disclosure relate to a method of applying a texture on a substrate. In some examples, the substrate may be a metal substrate (e.g., a metal sheet or a metal alloy sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials.

In some aspects, the substrate is a metal substrate. Although the following description is provided with reference to the metal substrate, it will be appreciated that the description is applicable to various other types of metal or non-metal substrates.

Disclosed are flatness control systems for controlling a flatness profile of a metal substrate processed by a finishing line.

The finishing line includes at least one work stand having a pair of vertically-aligned work rolls. During processing, a metal substrate is fed between the work rolls in a processing direction. Each work roll includes a width that extends transversely to the processing direction. Each work roll has a certain amount of stiffness such that, across its width, actuators of the flatness control system may cause localized bending of the work roll by applying a force to localized regions of the work roll. These regions of localized bending are flatness control zones of the work roll, and across its width, each work roll includes a plurality of flatness control zones. Localized bending in the flatness control zones causes the work roll to apply localized work roll pressures that can vary across the surface of the metal substrate to control flatness of the metal substrate. In other words, each work roll has a certain amount of stiffness such that the work roll can be bent, shaped or otherwise deformed as desired through the actuators to ultimately impart a desired flatness profile (e.g., substantially flat, curved, wavy, etc.) on the metal substrate as it exits the work stand.

The force applied to the work rolls by each actuator is a force such that the average load applied by the work roll across the width of the metal substrate (i.e., the average pressure applied by each flatness control zone of the work roll) is close to or below a yield strength of the metal substrate. The yield strength of the metal substrate refers to an amount of strength or pressure at which plastic deformation occurs through a portion of the thickness or gauge of the metal substrate (e.g., an amount of strength or pressure that can cause a substantially permanent change in a portion of the thickness or gauge of the metal substrate). The forces applied to the work rolls can cause the work rolls to impart an average work roll pressure on the metal substrate that is close to or below the yield strength of the metal substrate as the metal substrate passes between the work rolls. Because the average work roll pressure imparted by the work rolls on the metal substrate is below the yield strength of the metal substrate, the thickness of the metal substrate can remain substantially constant (e.g., there is substantially no reduction in the thickness of the metal substrate). In this same way, a length of the metal substrate can remain substantially constant.

In some examples, while the average work roll pressure is below the yield strength of the metal substrate, individual flatness control zones may apply forces that cause the work roll to apply localized work roll pressures above the yield strength of the metal substrate at localized regions on the surface of the metal substrate. At these localized areas, because the work roll pressure is greater than the yield strength of the metal substrate, the work roll can create localized regions of plastic deformation on the surface of the metal substrate and create localized strand elongation while leaving the remainder of the metal substrate un-deformed (e.g., the work roll causes plastic deformation at a particular location on the surface of the metal substrate while the thickness and length of the metal substrate remains substantially constant along the remainder of the metal substrate). For example, one flatness control zone may apply a work roll pressure that is significantly below the yield strength and another flatness control zone may apply a work roll pressure that is above the yield strength, but the average work roll pressure is less than the yield strength of the metal substrate. In some examples, the work roll pressure applied in one flatness control zone is greater than the yield strength such that portions of the metal substrate have localized strand elongation in the localized regions, but the work roll pressure is not sufficient to cause a substantial reduction in a thickness of the metal substrate at the localized regions. As an example, the work rolls may apply work roll pressures to the metal substrate such that a thickness of the metal substrate exiting the work stand is reduced by less than about 1.0%. For example, the thickness of the metal substrate exiting the work stand may be reduced from about 0.0% to about 1.0%. As one example, the thickness of the metal substrate may be reduced by less than about 0.2%. As another example, the thickness of the metal substrate may be reduced by less than about 0.1%.

In some examples, the average work roll pressure applied by the work rolls is such that a length of the metal substrate remains substantially constant (e.g., there is substantially no elongation or increase in the length of the metal substrate) as the metal substrate passes through a gap between the pair of work rolls. As an example, the work roll pressures applied to the metal substrate by the work rolls may cause the length of the metal substrate to increase between about 0.0% and about 1.0%. For example, the length of the metal substrate may increase by less than about 0.5% as the metal substrate passes through the gap. As an example, the length of the metal substrate may increase by less than about 0.2% or about 0.1%.

The flatness control system includes a controller, one or more flatness measuring devices, and the plurality of actuators. The flatness measuring device may be any device suitable for measuring a flatness profile of the metal substrate across its width. A multi-zone flatness measuring roll is one non-limiting example of a suitable flatness measuring device, although various other types of devices and sensors may be used. The one or more flatness measuring devices measure the flatness profile of the metal substrate at various locations within the finishing line relative to a work stand of the finishing line. For example, in some cases, the one or more flatness measuring devices measures the flatness profile before the metal substrate enters the work stand. In other examples, the one or more flatness measuring devices measures the flatness profile after the metal substrate exits the work stand. The controller is in communication with the flatness measuring device and the plurality of actuators. The controller receives the measured flatness profile from the one or more flatness measuring devices and adjusts one or more of the plurality of actuators such that the flatness profile of the metal substrate achieves a desired flatness profile (which may be predetermined or input by a user or based on modeling).

In various examples, the finishing line is configured to both provide the metal substrate with the desired flatness profile and apply a texture to the surface of the metal substrate. In some examples where the finishing line includes one work stand, each work roll may have a surface roughness that is close to the surface roughness of the metal substrate to provide the metal substrate with the desired flatness profile and uniform surface topography. In other examples, the finishing line may include more than one work stand, such as two or more work stands. In such cases, the first work stand and the second work stand may be substantially similar except for the surfaces of the work rolls. For example, the work rolls of the first work stand may have a relatively smooth outer surface such that the first stand may simultaneously provide the desired flatness profile and can smooth the topography of the metal substrate (i.e., to have a surface roughness lower than about 0.4-0.6 μm). The work rolls of the second work stand may have a textured surface such that the work rolls can impress various textures, features, or patterns on the surface of the metal substrate without reducing the overall thickness of the metal substrate. In additional or alternative examples, the multiple work rolls can impress the various textures, features, or patterns on the surface of the metal substrate while maintaining the thickness of the metal substrate (e.g., the multiple work rolls may not reduce the thickness of the metal substrate while impressing the textures, features, or patterns), which can sometimes be referred to as zero reduction texturing.

FIG. 1 illustrates an example of a finishing line 100 according to aspects of the present disclosure. The finishing line 100 includes a work stand 102. In some examples, the finishing line 100 includes more than one work stand 102 (see, e.g., FIG. 6). In addition to the work stand 102, the finishing line 100 may include various other processing stations and may have various line configurations (which refers to the processing stations as well as order of the processing stations). For example, the finishing line 100 configuration could include the work stand 102 and a slitting station. The finishing line 100 may have various other line configurations.

The work stand 102 includes a pair of vertically aligned work rolls 104A-B. In various examples, the work stand 102 includes more than one pair of vertically aligned work rolls 104A-B (see FIGS. 8 and 9). For example, in some cases, the work stand 102 includes two pairs of work rolls 104A-B, three pairs of work rolls 104A-B, four pairs of work rolls 104A-B, or any other desired number of work rolls 104A-B. A gap 106 is defined between the work rolls 104A-B that is configured to receive a metal substrate 108 during processing of a metal substrate 108, as described in detail below. In other examples, a substrate may be various other metal or non-metal substrates. During processing, the work rolls 104A-B are configured to contact and apply work roll pressures to the upper surface 110 and the lower surface 112 of the metal substrate 108, respectively, as the metal substrate 108 passes through the gap 106 in a processing direction 101. In various examples, the work rolls 104A-B process the metal substrate 108 such that the tension is from about 2 to 45 MPa, which is typically less than (and often much less than) the yield point of the material. As one non-limiting example, in some cases, the tension may be about 15 MPa.

The work rolls 104A-B are generally cylindrical and can be driven by a motor or other suitable device for driving the work rolls 104A-B and causing the work rolls 104A-B to rotate. Each work roll 104A-B has an outer surface 114 that contacts the surfaces 110 and 112 of the metal substrate 108 during processing. In some examples, the outer surface 114 of one or both work rolls 104A-B is of the same roughness or smoother than the incoming strip (i.e., having a surface roughness lower than about 0.4-0.6 μm), such that during processing, the outer surface(s) 114 of the work rolls 104A-B smooth a topography of the surfaces 110 and/or 112 of the metal substrate 108. In other examples, the outer surface(s) 114 of the work rolls 104A-B includes one or more textures that are at least partially transferred onto one or both of the surfaces 110 and 112 of the metal substrate 108 as the metal substrate 108 passes through the gap 106. In some examples, the texture on the outer surface(s) 114 of the work rolls 104A-B matches or closely approximates a surface roughness of the surfaces 110 and/or 112 of the metal substrate 108 to provide a uniform surface topography to the metal substrate 108. Surface roughness can be quantified using optical interferometry techniques or other suitable methods. In some examples, the textured sheet may have a surface roughness from about 0.4 μm to about 6.0 μm. In some examples, the textured sheet may have a surface roughness from about 0.7 μm to about 1.3 μm. In various examples, one or both work rolls 104A-B may be textured through various texturing techniques including, but not limited to, electro-discharge texturing (EDT), electrodeposition texturing, electron beam texturing (EBT), laser beam texturing, electrofusion coatings and various other suitable techniques.

The rolls and roll stacks 104A-B, 119A-B, 116A-B (intermediate rolls 119A-B and actuators 116A-B are described in detail below) each have a certain amount of stiffness (or flexibility). The stiffness property of these items 104A-B, 119A-B, 116A-B is generally described by the following equation (1):

$$k = C * \frac{EI}{L^3}$$

In the above equation (1), L is the length of the roll, and C is a coefficient that varies based on the loading applied. E is the elastic modulus of the rolls, and I is the area moment of inertia of the rolls and the roll stacks 104A-B, 119A-B, 116A-B. A roll stack refers to the combination of work rolls 104A-B and intermediate rolls 119A-B. The area moment of inertia I for the rolls (or $I_{stack}$ for the roll stack) is generally described by the following equation (2):

$$I_{stack} = \sum_{i=1}^{n} (I_{WR_n}(x, y) + A_{WR_n} * d_{WR_n}(x, y)^2) + \sum_{i=1}^{n} (I_{IMR_n}(x, y) + A_{IMR_n} * d_{IMR_n}(x, y)^2)$$

In the above equation (3), $I_{WR}$ is the area moment of inertia of each respective work roll 104A-B, $A_{WR}$ is the cross-sectional area of each respective work roll 104A-B, $d_{WR}$ is the distance of the centroid of the roll from the x axis in they axis direction (see FIG. 1). Similarly, $I_{IMR}$ is the area moment of inertia of each respective intermediate roll 119A-B, $A_{IMR}$ is the cross-sectional area of each respective intermediate roll 119A-B, $d_{IMR}$ is the distance of the centroid of the roll from the x and y axis.

In various examples, the roll stack has an area moment of inertia to bending about the x-axis of from about 7.85E-08 m to about 0.0105 $m^4$. In certain examples, the roll stack has an area moment of inertia to bending about the x-axis of from about 9.69E-06 m to about 1.55E-04 $m^4$. In various cases, the roll stack has an area moment of inertia to bending about the x-axis of from about 1.49E-05 m to about 1.13E-04 $m^4$.

In some examples, the length of these rolls may be from about 5 mm to about 3000 mm, although in some examples, the length may be more than 3000 mm. In some examples, the stiffness of at least one of the rolls 104A-B, 119A-B, 116A-B may be controlled by adjusting any of the aforementioned variables or arranging the rolls in a different pattern. As one non-limiting example, the diameter of the rolls 104A-B, 119A-B, and/or 116A-B and the spatial pattern these rolls are arranged in may be adjusted to achieve the desired stiffness. In various examples, each work roll 104A-B, 119A-B, and/or 116A-B may have a diameter of from about 0.020 m to about 0.200 m. In some examples, the diameter is from about 0.030 m to about 0.060 m. In some examples, the diameter may be about 0.045 m. As described in detail below, the stiffness of at least one of the rolls 104A-B, 119A-B, and/or 116A-B is below a predetermined amount to allow for localized work roll pressure control by the roll stack 104A-B, 119A-B, and/or 116A-B.

In various examples, the work roll pressures applied by the work rolls 104A-B to the metal substrate 108 allow the thickness of the metal substrate 108 and the length of the metal substrate 108 to remain substantially constant (e.g., there is substantially no reduction in the overall thickness of the metal substrate 108 and substantially no increase in the length of the metal substrate 108). As an example, the work roll pressures applied by the work rolls 104A-B may cause the thickness of the metal substrate 108 to decrease from about 0.0% and about 1.0%. For example, the thickness of the metal substrate 108 may decrease by less than about 0.5% as the metal substrate 108 passes through the gap 106. As an example, the thickness of the metal substrate 108 may decrease by less than about 0.2% or about 0.1%.

More specifically, the work rolls 104A-B apply work roll pressures such that the average work roll pressure applied across the width of the metal substrate 108 is close to or below a yield strength of the metal substrate 108, which can prevent the thickness of the metal substrate 108 from being substantially reduced (e.g., reduced by more than about 1.0%) as the metal substrate 108 passes through the gap 106. The yield strength of a substrate refers to an amount of strength or pressure at which plastic deformation occurs through substantially the entire thickness or gauge of the substrate 108 (e.g., an amount of strength or pressure that can cause a substantially permanent change in substantially the entire thickness or gauge of the substrate 108). During processing, to prevent the thickness of the metal substrate from being reduced, the forces imparted to the work rolls 104A-B by the actuators are such that the work rolls 104A-B impart an average work roll pressure on the metal substrate 108 that is close to or below the yield strength of the metal substrate 108 as the metal substrate 108 passes through the gap 106. Because the average work roll pressure imparted by the work rolls 104A-B on the metal substrate 108 is close to or below the yield strength of the metal substrate 108, the thickness of the metal substrate 108 remains substantially constant (e.g., the thickness of the metal substrate 108 remains substantially constant and there is substantially no reduction in the thickness of the metal substrate 108).

While the average work roll pressure applied by the work rolls 104A-B is below the yield strength of the metal substrate 108, localized work roll pressure control by the work rolls 104A-B may create localized regions on the metal substrate 108 where the work roll pressure applied by the work rolls 104A-B is above the yield strength of the metal substrate 108 as the metal substrate 108 passes between the work rolls 104A-B. At these localized regions, because the work roll pressure is greater than the yield strength of the metal substrate 108, localized regions of partial plastic deformation are formed for localized strand elongation to improve flatness that leaves the remainder of the metal substrate 108 un-deformed (e.g., the localized work roll pressure causes plastic deformation at a particular location on the metal substrate 108 while the overall thickness of the metal substrate 108 remains substantially constant along the remainder of the metal substrate 108). Thus, in some examples, the work rolls 104A-B can be used to cause localized regions of plastic deformation on the metal substrate 108 without changing the overall thickness of the metal substrate 108 (e.g., without reducing the thickness of the entire metal substrate 108).

In some examples, the average work roll pressure applied by the work rolls 104A-B is such that a length of the metal substrate 108 remains substantially constant (e.g., there is substantially no elongation or increase in the length of the metal substrate 108) as the metal substrate 108 passes through the gap 106. As an example, the work roll pressure applied by the work rolls 104A-B may cause the length of the metal substrate 108 to increase between about 0.0% and about 1.0%. For example, the length of the metal substrate 108 may increase by less than about 0.5% as the metal substrate 108 passes through the gap 106. As an example, the length of the metal substrate 108 may increase by less than about 0.2% or about 0.1%.

As described above, off-flatness, or deviations from flatness, across the width of the metal substrate 108 is caused by internal stresses or tensions in the metal substrate 108. During processing within the finishing line 100, one or both of the work rolls 104A-B may apply localized work roll pressures above the yield strength of the metal substrate 108 at regions of high tension on the metal substrate 108 to cause localized strand elongation in the regions of high tension (i.e., the length will increase in the locally yielded location only). Localized strand elongation reduces tension in those regions, which in turn improves the overall strip flatness. Therefore, by providing localized work roll pressure control, the finishing line 100 is able to substantially maintain the thickness and length of the metal substrate 108 while selectively applying work roll pressures to particular regions of the metal substrate 108 with high tension to cause localized strand elongation that improves flatness.

The finishing line 100 may also include a flatness control system 120. As illustrated in FIG. 1, the flatness control system 120 includes a controller 118, a flatness measuring device 122, and a plurality of actuators 116A-B (also known as "backup rolls"). The number or location of actuators 116A-B at a particular region of a corresponding work roll 104A-B should not be considered limiting on the current disclosure. For example, FIG. 1 illustrates an example of a configuration of two actuators 116A-B at a corresponding region of the respective work roll 104A-B. However, in other examples, one actuator 116A-B or more than two actuators 116A-B may be provided for the particular region of the respective work rolls 104A-B.

The controller 118 is in communication with the flatness measuring device 122 and the plurality of actuators 116A-B. As described below, based on various sensor data sensed from the flatness measuring device 122, the controller 118 is configured to adjust one or more of the plurality of actuators 116A-B such that the metal substrate 108 achieves the desired flatness profile.

The flatness measuring device 122 measures an actual flatness profile of the metal substrate 108 as it is processed. In the illustrated example, the flatness measuring device 122 is a multi-zone flatness measuring roll. However, in other examples, the flatness measuring device 122 may be one or more various suitable devices or sensors. The location of the flatness measuring device 122 relative to the work stand 102 should not be considered limiting on the current disclosure. For example, in some examples, the flatness measuring device 122 is upstream of the work stand 102 such that the actual flatness profile of the metal substrate 108 is measured before the metal substrate 108 enters the work stand 102. In other examples, the flatness measuring device 122 is downstream of the work stand 102 such that the actual flatness profile of the metal substrate 108 is measured after metal substrate 108 exits the work stand 102.

The plurality of actuators 116A-B are provided to impart localized forces on the respective work rolls 104A-B, sometimes through intermediate rolls 119A-B, respectively. As illustrated in FIG. 1, the intermediate rolls 119A support the work roll 104A and the intermediate rolls 119B support the work roll 104B. Although two intermediate rolls 119A are shown with the work roll 104A and two intermediate rolls 119B are shown with the work roll 104B, the number of intermediate rolls 119A-B should not be considered limiting on the current disclosure. In some examples, the intermediate rolls 119A-B are provided to help prevent the work rolls 104A-B from separating as the metal substrate 108 passes through the gap 106. The intermediate rolls 119A-B are further provided to transfer the localized forces on the respective work rolls 104A-B from the respective actuators 116A-B. In some examples, the intermediate rolls have a diameter and stiffness equal or greater than the diameter and stiffness of the work rolls 104A-B, although they need not. In this way, the work rolls 104A-B apply the localized work roll pressures to the metal substrate 108 within each flatness control zone to locally lengthen the metal substrate 108. While intermediate rolls 119A-B are illustrated, in some examples, the intermediate rolls 119A-B may be omitted from the finishing line 100, and the actuators 116A-B may directly or indirectly impart forces on the work rolls 104A-B, respectively (see, e.g., FIGS. 7 and 8).

In various examples, the actuators 116A are provided to impart the forces on the work roll 104A and the actuators 116B are provided to impart the forces on the work roll 104B. The number and configuration of the actuators 116A-B should not be considered limiting on the current disclosure as the number and configuration of the actuators 116A-B may be varied as desired. In various examples, the actuators 116A-B are oriented substantially perpendicular to the processing direction 101. In some examples, each actuator 116A-B has a profile with a crown or chamfer across a width of the respective actuator 116A-B, where crown generally refers to a difference in diameter between a centerline and the edges of the actuator (e.g., the actuator is barrel-shaped). The crown or chamfer may be from about 0 μm to about 50 μm in height. In one non-limiting example, the crown is about 30 μm. In another non-limiting example, the crown is about 20 μm. In some examples, the crown of the actuators 116A-B may be controlled to further control the forces imparted on the work rolls 104A-B, respectively. In some examples, the actuators 116A-B are individually controlled through a controller 118. In other examples, two or more actuators 116A-B may be controlled together.

Figure 2:
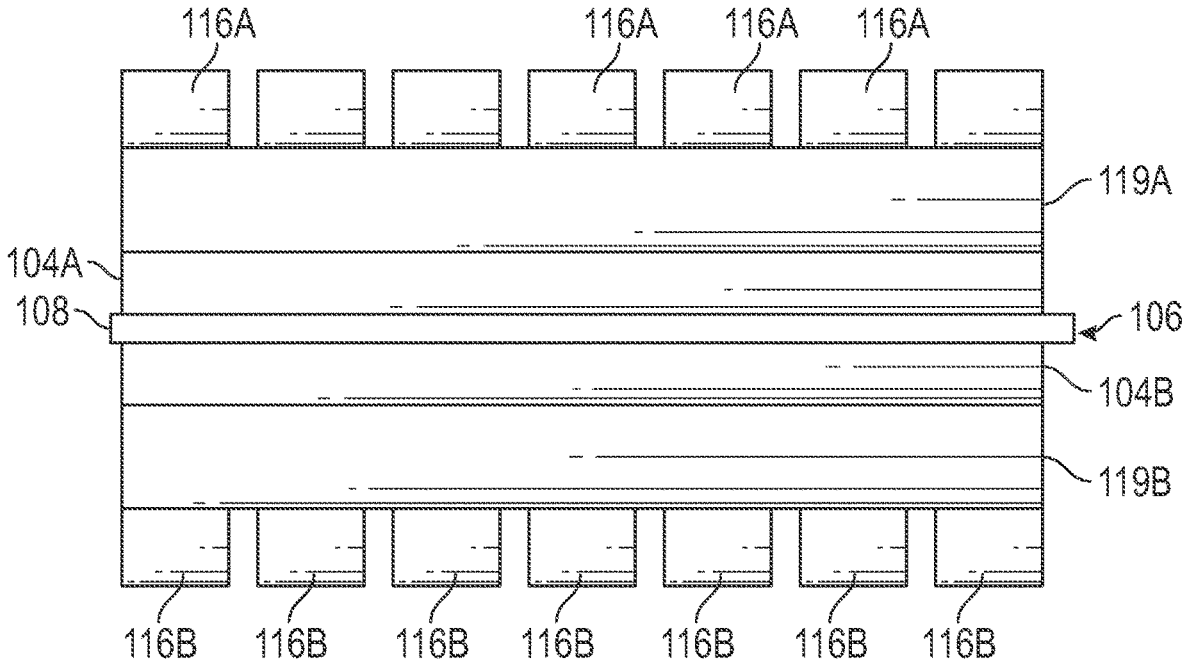
FIG. 2 is a schematic end view of the work stand of FIG. 1.
Figure 3:
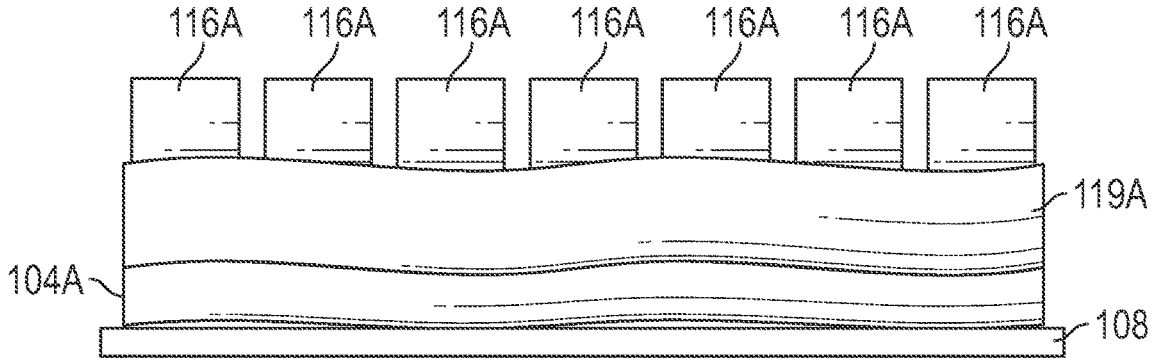
FIG. 3 is another schematic of the work stand of FIG. 1.

As illustrated in FIG. 2, each actuator 116A-B corresponds with a particular region (i.e., flatness control zone) of the respective work rolls 104A-B, which in turn corresponds with a particular region of the metal substrate 108. Because each actuator 116A-B is individually controlled, a desired flatness profile of the metal substrate 108 can be achieved. For example, as illustrated in FIG. 3 (which only shows the actuators 116A, the work roll 104A, and the metal substrate 108), different actuators 116A may apply different forces to the work roll 104A to cause bending, shaping or other deformation of the work roll 104A. In various examples, the difference in work roll pressure from zone to zone is minimized. In some cases, both work rolls 104A-B include flatness control zones; in other cases, only one of the work rolls 104A-B includes flatness control zones. In certain aspects, a density of the actuators 116A-B, or a number of actuators acting on a particular portion of the work rolls 104A-B, may be varied along the work rolls 104A-B. For example, in some cases, the number of actuators 116A-B at edge regions of the work rolls 104A-B may be different from the number of actuators 116A-B at a center region of the work rolls 104A-B. In some examples, a characteristic of the actuators 116A-B may be adjusted or controlled depending on desired location of the particular actuators 116A-B along the width of the work rolls. As one non-limiting example, the crown or chamfer of the actuators 116A-B proximate to edges of the work rolls may be different from the crown or chamfer of the actuators 116A-B towards the center of the work rolls. In other aspects, the diameter, width, spacing, etc. may be controlled or adjusted such that the particular characteristic of the actuators 116A-B may be the same or different depending on location. In some aspects, actuators having different characteristics in the edge regions of the work rolls compared to actuators in the center regions of the work rolls may further allow for uniform pressure or other desired pressure profiles during texturing. For example, in some cases, the actuators may be controlled to intentionally change the flatness and/or texture of the metal substrate 108. As some examples, the actuators 116A-B may be controlled to intentionally create an edge wave, create a thinner edge, etc. Various other profiles may be created.

By bending or deforming different regions of the work roll 104A during processing of the metal substrate 108, some regions of the metal substrate 108 may have a reduced work roll pressure such that there is little to no tension reduction, while other regions of the metal substrate have increased work roll pressures such that there is tension reduction.

Figure 4A:
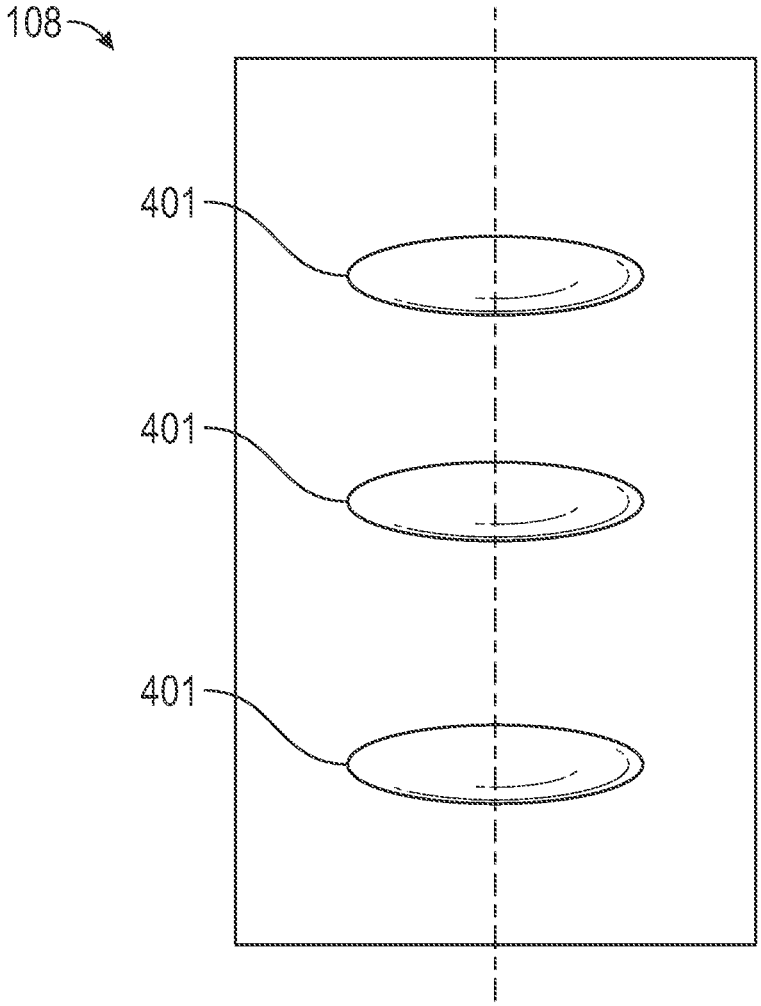
FIG. 4A is an example of a flatness profile of a metal substrate.
Figure 4B:
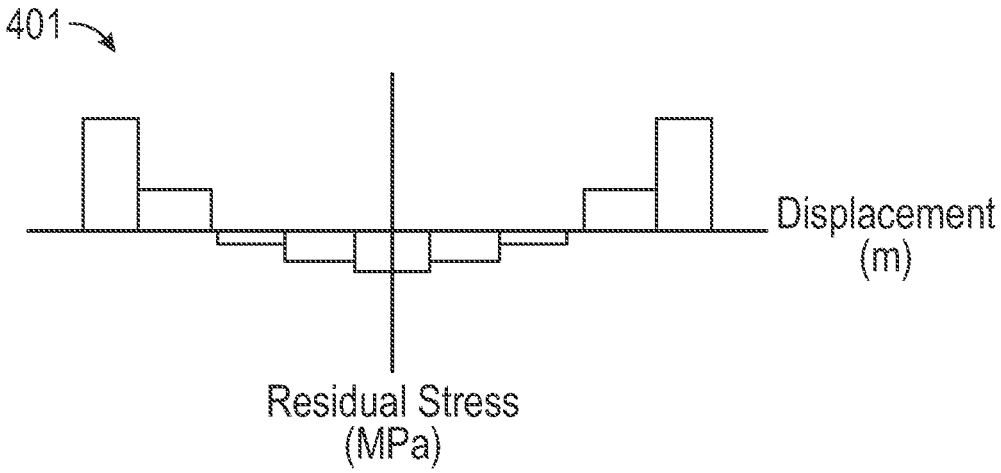
FIG. 4B is a graph illustrating the strain profile of the metal substrate of FIG. 4A.

As one non-limiting example, referring to FIGS. 4A and 4B, the metal substrate 108 may have regions of increased tension 401 in the edge regions of the metal substrate 108. In this example, the actuators 116A and/or 116B may cause the work rolls 104A and/or 104B to apply increased localized work roll pressures in the edge regions (to decrease tension at the corresponding regions of the metal substrate 108) of the work roll(s) and/or decreased localized work roll pressures at the center region (such that there is little to no tension reduction at the corresponding regions of the metal substrate 108) of the work roll(s). FIG. 4B schematically illustrates the residual stress (MPa) vs. displacement (m) of the metal substrate 108 of FIG. 4A.

Figure 5A:
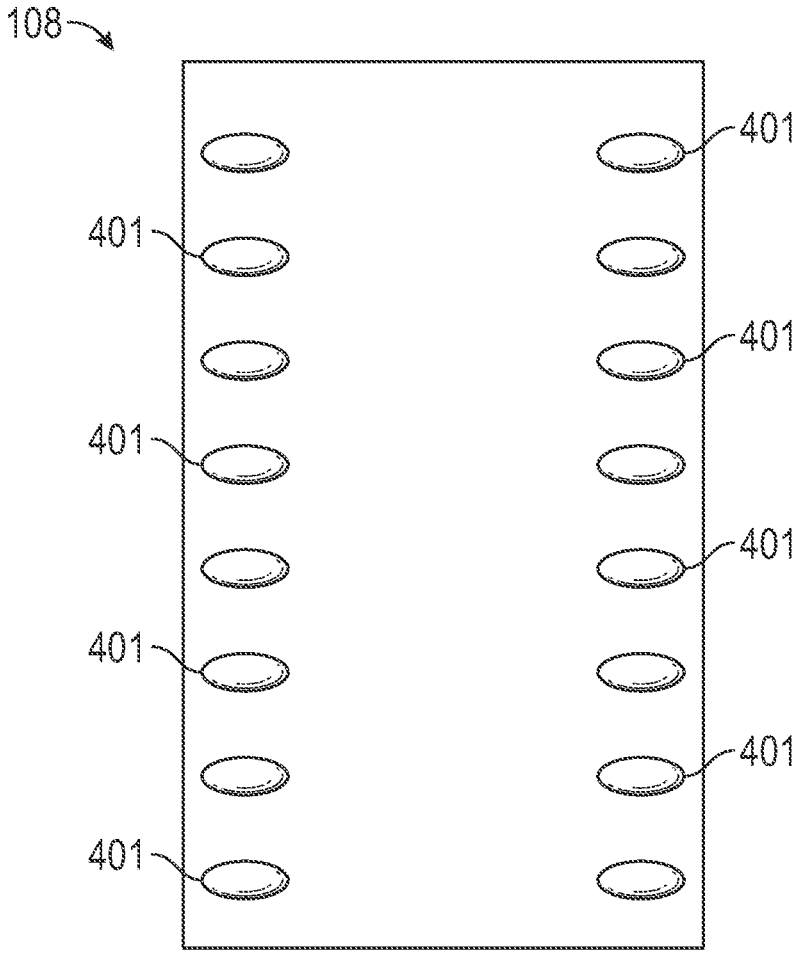
FIG. 5A is another example of a flatness profile of a metal substrate.
Figure 5B:
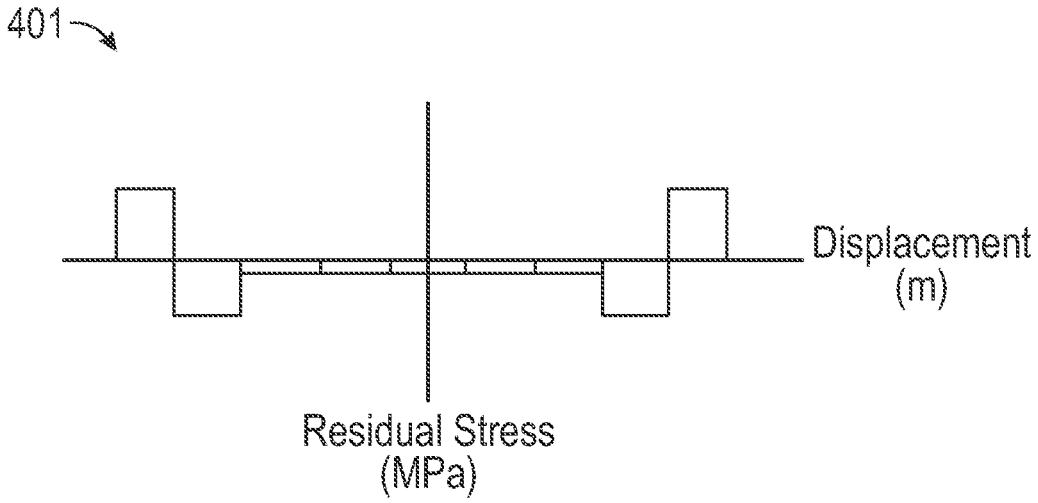
FIG. 5B is a graph illustrating the strain profile of the metal substrate of FIG. 5A.

Another non-limiting example is illustrated in FIGS. 5A and 5B. In this example, the metal substrate 108 has very localized regions of increased tension 401 at edge regions of the metal substrate 108. During processing, the actuators 116A and/or 116B may cause the work rolls 104A and/or 104B to apply increased localized work roll pressures at the edge regions of the work roll(s) (to decrease tension at the corresponding regions of the metal substrate 108) and/or decreased localized work roll pressures at the center region of the work roll(s) (such that there is little to no tension reduction at the corresponding regions of the metal substrate 108). FIG. 5B schematically illustrates the residual stress (MPa) vs. displacement (m) of the metal substrate 108 of FIG. 5A.

Referring back to FIG. 1, in some cases, during texturing, the upper work roll 104A may be actuated in the direction generally indicated by arrow 103 and the lower work roll 104B may be actuated in the direction generally indicated by arrow 105. In such examples, the work rolls are actuated against both the upper surface 110 and the lower surface 112 of the metal substrate 108. However, in other examples, only one side of the stand 102/only one of the work rolls 104A-B may be actuated, and actuation indicated by the arrow 103 or actuation indicated by the arrow 105 may be omitted. In such examples, during texturing, the actuators on one side may be frozen and/or may be omitted altogether such that one of the work rolls 104A-B is not actuated (i.e., actuation on the metal substrate is only from one side of the metal substrate). For example, in some cases, the lower actuators 116B may be frozen such that the lower work roll 104B is frozen (and is not actuated in the direction indicated by arrow 105). In other examples, the lower actuators 116B may be omitted such that the lower work roll 104B is frozen.

Figure 6:
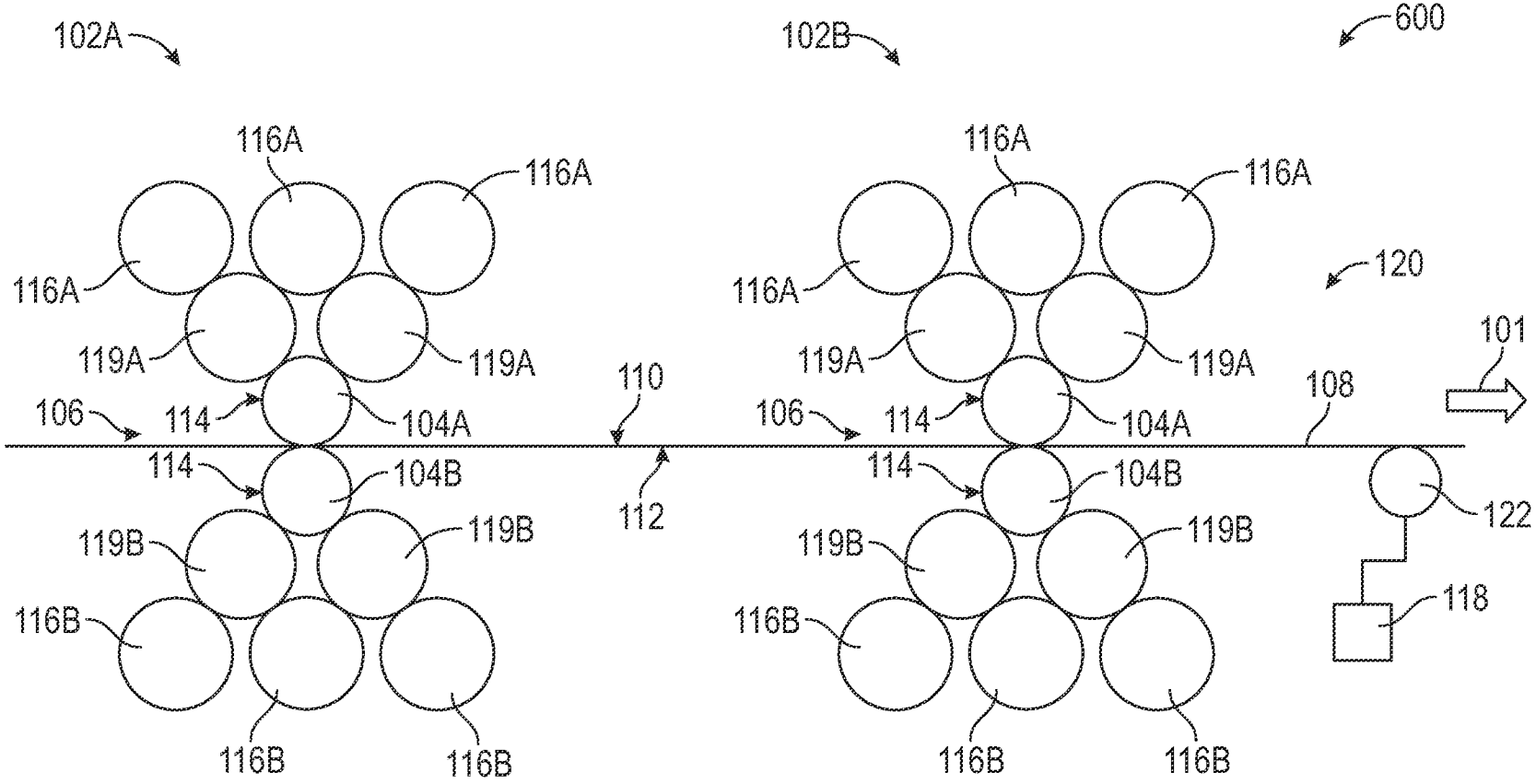
FIG. 6 is a schematic of a multi-stand finishing line including one or more work stands and flatness control system according to aspects of the present disclosure.

FIG. 6 illustrates an example of a finishing line 600 according to aspects of the present disclosure. Compared to the finishing line 100, the finishing line 600 includes two work stands 102A-B. In this example, the work stand 102A includes work rolls 104A-B that have a smooth outer surface for simultaneous flattening and smoothing of the metal substrate 108. The work stand 102B includes work rolls 104A-B, one or both of which have a texture on the outer surface that is applied to the metal substrate 108. In this example, the work stand 102A is upstream of the work stand 102B. As noted above, various other implementations and configurations are possible.

In various examples, a method of controlling a flatness of the metal substrate 108 with the finishing line 100 (or finishing line 600) includes directing the metal substrate 108 between the work rolls 104A-B of the work stand 102 of the finishing line 100. The flatness measuring device 122 of the flatness control system 120 measures an actual flatness profile of the metal substrate 108. In some examples, the flatness measuring device 122 measures the actual flatness profile upstream from the work stand 102. In other examples, the flatness measuring device 122 measures the actual flatness profile downstream from the work stand 102.

The controller 118 of the flatness control system 120 receives the sensed data from the flatness measuring device 122, and compares the actual flatness profile to a desired flatness profile. In some examples, the desired flatness profile may be predetermined or input by an operator of the finishing line 100 or may be based on modeling. The desired flatness profile may be any flatness profile of the metal substrate 108 as desired, including, but not limited to, substantially flat, curved or bowed, wavy, etc.

Based on the comparison of the actual flatness profile to the desired flatness profile, the controller 118 may adjust at least one of the actuators 116A-B to adjust a force applied by the actuators 116A-B on at least one of the work rolls 104A-B. As described above, each actuator 116A-B corresponds with a particular flatness control zone along the width of the respective work rolls 104A-B. By adjusting one or more of the actuators, the localized forces applied by the actuators 116A-B to the work rolls 104A-B cause some flatness control zones of the work rolls 104A-B to apply a work roll pressure at one region of the metal substrate 108 that is different that the work roll pressure applied by another flatness control zone at another region of the metal substrate 108. Thus, the actuators 116A-B cause the work rolls 104A-B to apply localized work roll pressures such that the actual flatness profile can be adjusted to achieve the desired flatness profile.

In various examples, as also mentioned above, the actuators 116A-B cause at least one of the work rolls 104A-B to apply localized work roll pressures such that the average work roll pressure applied across the width of the metal substrate is less than the yield strength of the substrate. In some examples, the work rolls 104A-B apply localized work roll pressures to the metal substrate 108 such that the thickness of the metal substrate 108 remains substantially constant. In some cases, the thickness of the metal substrate 108 is reduced by less than approximately 1%. In some cases, the work rolls 104A-B apply localized work roll pressures to the metal substrate 108 such that the length of the metal substrate 108 remains substantially constant. In various cases, the length of the metal substrate 108 increases by less than approximately 1%. In various examples, the actuators 116A-B cause the work rolls 104A-B to apply localized work roll pressures that are greater than the yield strength of the metal substrate 108 at specific regions of the metal substrate to cause localized strand elongation that reduces tension at those specific regions and increases flatness along the width of the metal substrate 108.

In some examples, the method includes applying a texture to one or more surfaces of the metal substrate. In some examples, a single stand 102 includes work rolls 104A-B having a surface roughness close to that of the metal substrate 108 such that the substrate 108 has a desired flatness profile and uniform surface topography upon exiting the stand 102. In other examples, the finishing line is a two-stand system with smooth work rolls 104A-B in the first stand 102 and textured work rolls 104A-B in the second stand 102. The first stand 102 simultaneously flattens the sheet and smooths the topography of the metal substrate 108 using a low-pressure, load profile controlled stand 102 with smooth work rolls 104A-B. The second stand 102 with textured work rolls 104A-B may then be used to texture the metal substrate 108, taking advantage of the smooth surface topography achieved by the first stand 102.

In various other examples, a finishing line may have one stand 102, two stands 102, or more than two stands 102. As one non-limiting example, a finishing line may have six stands 102. In some examples, the first stand 102 may be used to improve flatness of the metal substrate 108 by using work rolls 104A-B with equal or lower surface roughness than the incoming metal substrate 108. Subsequent stands (e.g., stands two through 6) may be used to apply a surface texture using textured work rolls 104A-B. Various other finishing line configurations may be provided.

Figure 7:
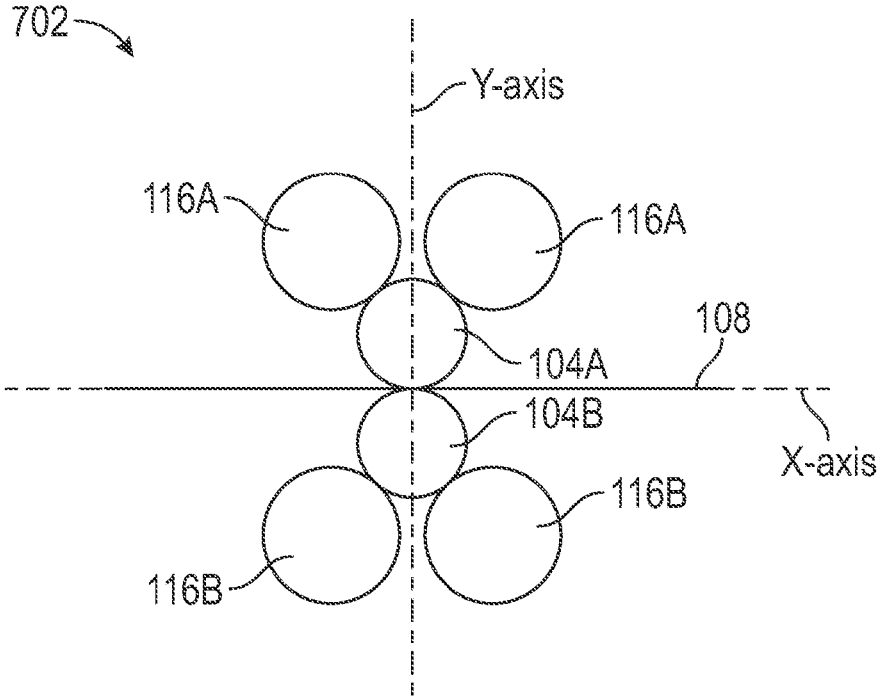
FIG. 7 is a schematic of a work stand according to aspects of the present disclosure.

FIG. 7 illustrates an example of a work stand 702. Compared to the work stands 102, the work stand 702 includes actuators 116A-B directly contacting the work rolls 104A-B. In the example illustrated in FIG. 7, two actuators 116A contact the work roll 104A and two actuators 116B contact the work roll 104B, although any desired number of actuators 116A-B and/or work rolls 104A-B may be provided.

Figure 8:
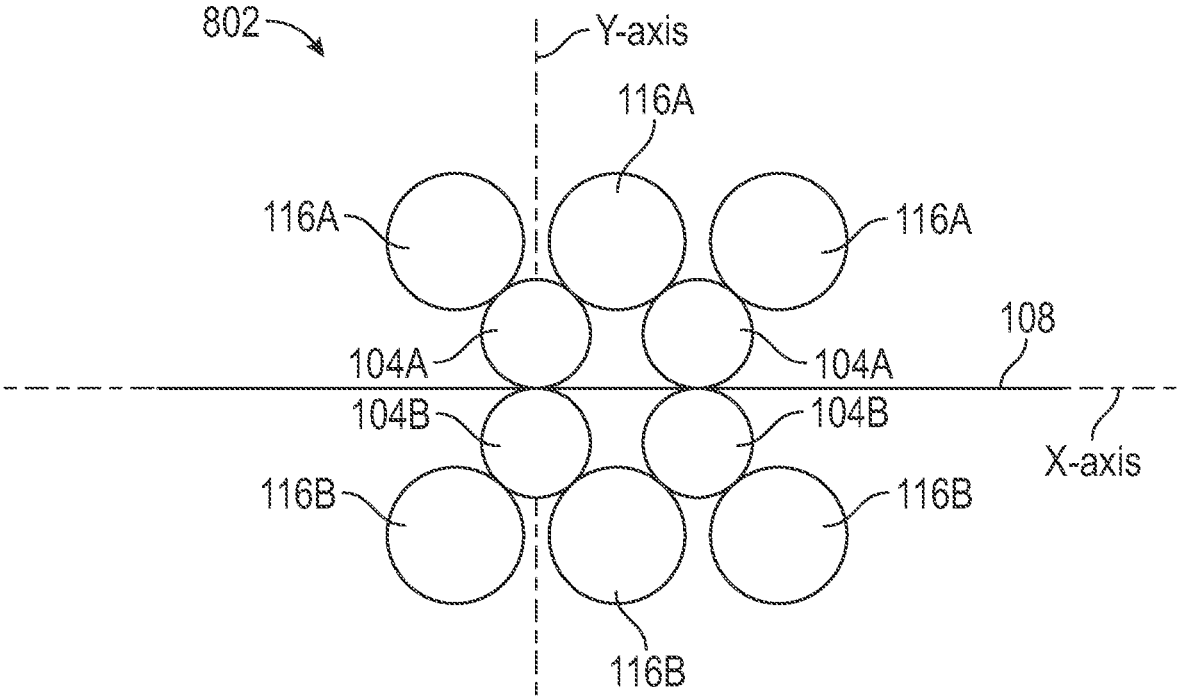
FIG. 8 is a schematic of a work stand according to aspects of the present disclosure.

FIG. 8 illustrates an example of a work stand 802. Compared to the work stands 102, the work stand 802 includes two pairs of work rolls 104A-B (and thus four work rolls 104A-B total). Similar to the work stand 702, the work stand 802 includes actuators 116A-B directly contacting the work rolls 104A-B. In the example illustrated in FIG. 8, three actuators 116A contact the two work rolls 104A (two actuators 116A per work roll 104A), and three actuators 116B contact the two work rolls 104B (two actuators 116B per work roll 104B), although any desired number of actuators 116A-B and/or work rolls 104A-B may be provided.

Figure 9:
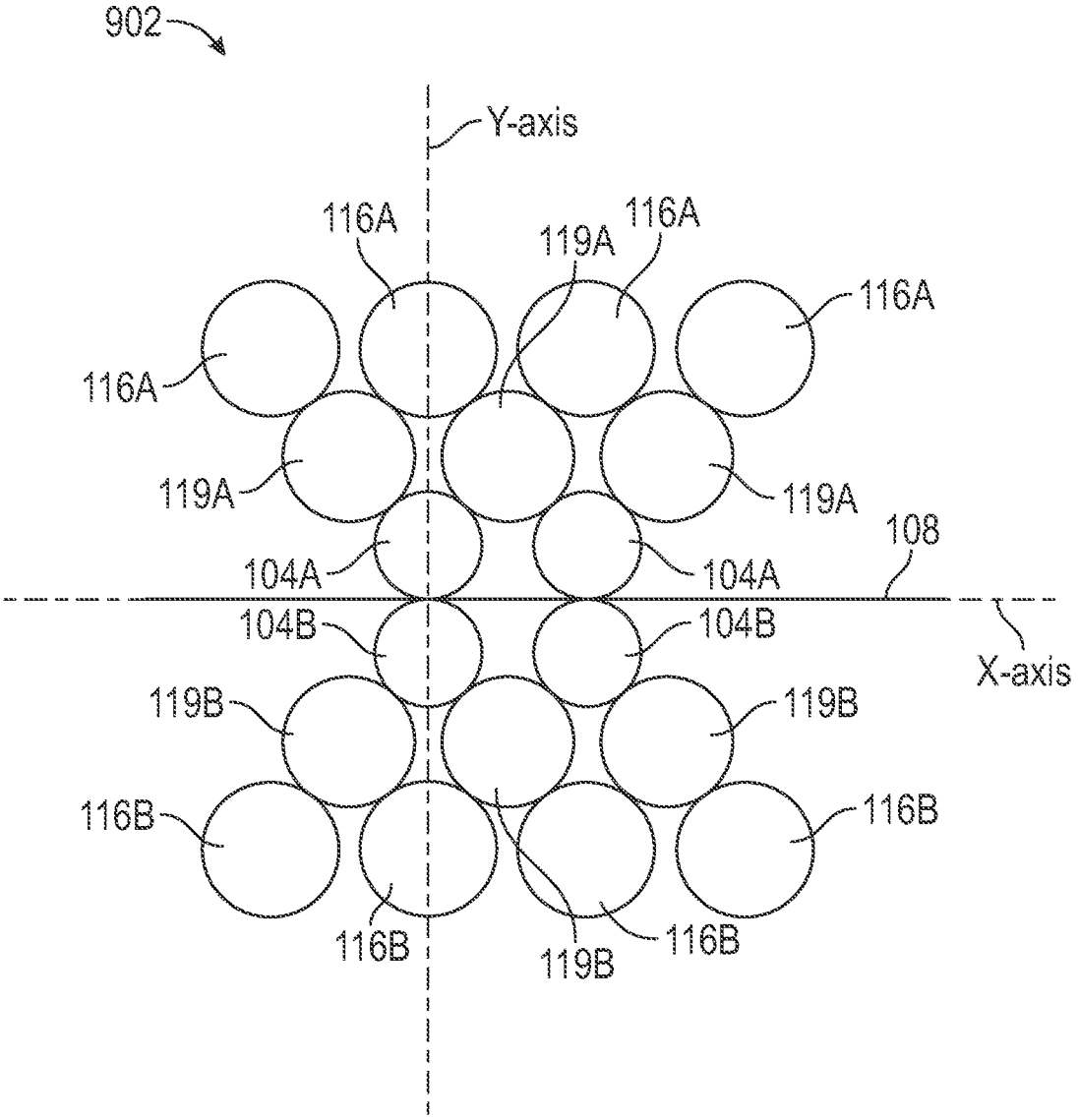
FIG. 9 is a schematic of a work stand according to aspects of the present disclosure.

FIG. 9 illustrates an example of a work stand 902. Compared to the work stands 102, the work stand 902 includes two pairs of work rolls 104A-B (and thus four work rolls 104A-B total). In the example illustrated in FIG. 9, the work stand 902 includes eight actuators 116A-B, six intermediate rolls 119A-B, and four work rolls 104A-B, although any desired number of work rolls 104A-B, intermediate rolls 119A-B, and/or actuators 116A-B may be provided.

In some examples, one side of the work stand may be frozen such that only one side of the stand is actuated (i.e., the stand is actuated only in the direction 103 or only in the direction 105). In such examples, the vertical position of the lower work roll 104B is constant, fixed, and/or does not move vertically against the metal substrate.

Figure 10:
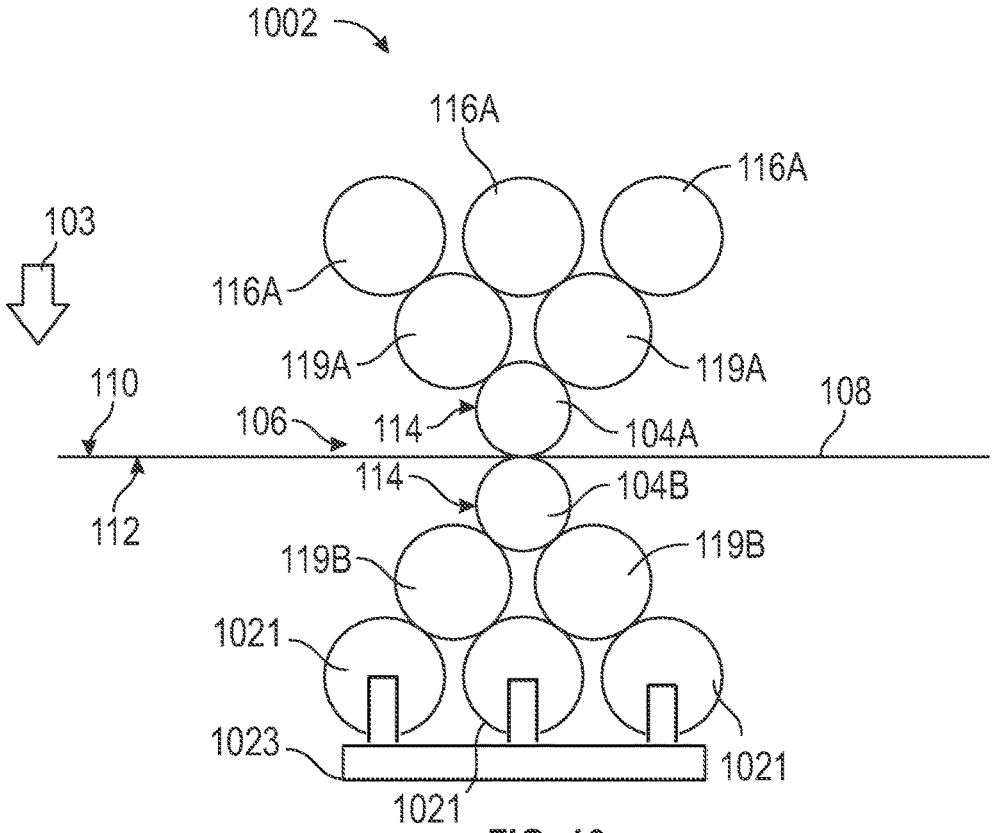
FIG. 10 is a schematic a work stand according to aspects of the present disclosure.
Figure 11:
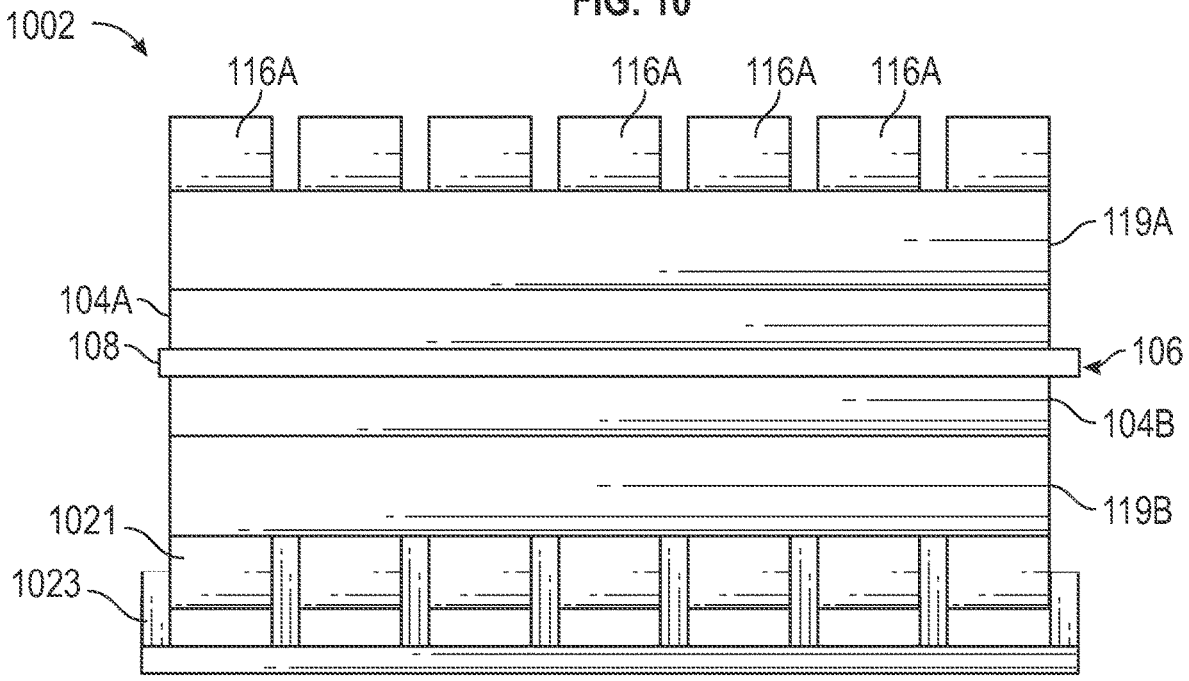
FIG. 11 is a schematic end view of the work stand of FIG. 10.
Figure 12:
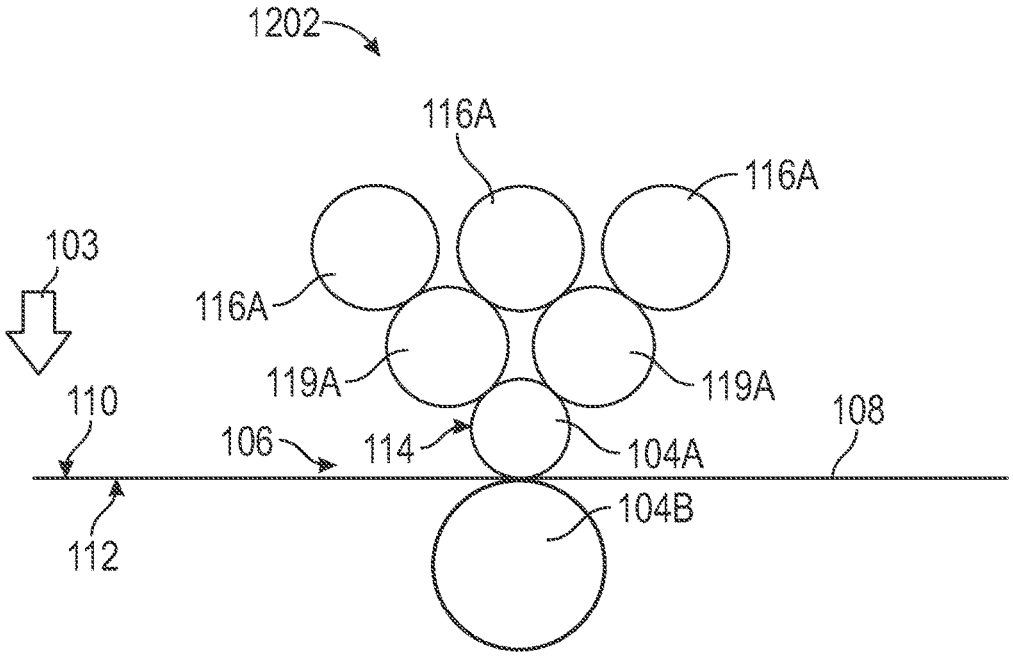
FIG. 12 is a schematic of a work stand according to aspects of the present disclosure.
Figure 13:
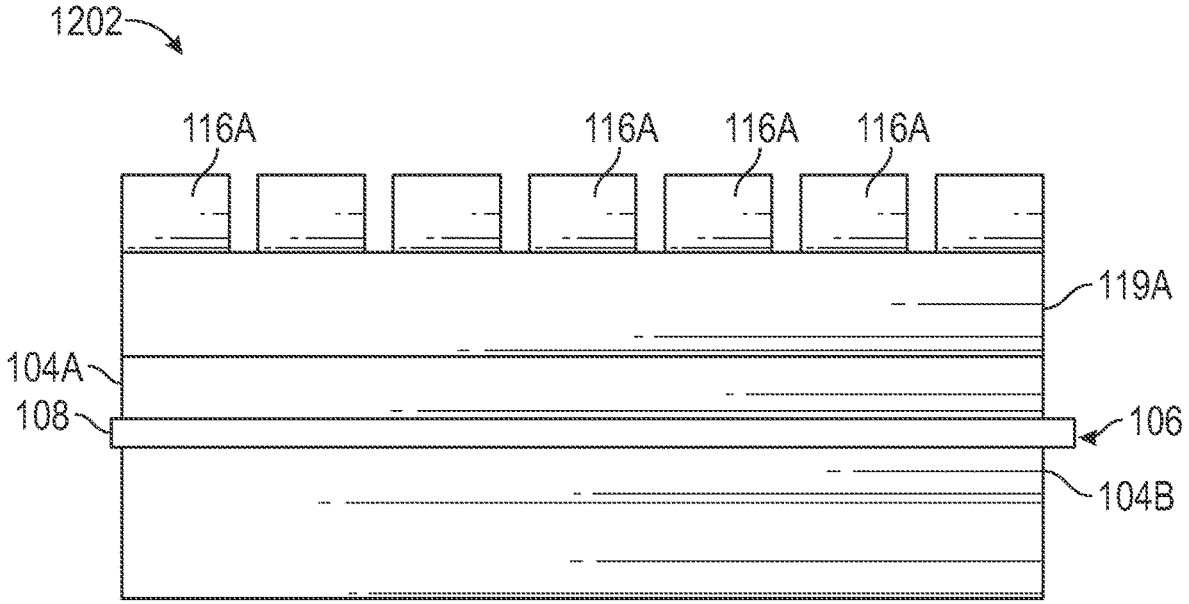
FIG. 13 is a schematic end view of the work stand of FIG. 12.

In some aspects where actuators are included on both the upper and lower sides of the stand, one side of the work stand may be frozen by controlling one set of actuators such that they are not actuated. For example, in some cases, the lower actuators 116B may be frozen such that the lower work roll 104B not actuated in the direction 105. In other examples, the lower actuators 116B may be omitted such that the lower work roll 104B is frozen. In other examples, various other mechanisms may be utilized such that one side of the stand is frozen. For example, FIGS. 10 and 11 illustrate an additional example of a work stand where one side is frozen, and FIGS. 12 and 13 illustrate a further example of a work stand where one side is frozen. Various other suitable mechanisms and/or roll configurations for freezing one side of the work stand while providing the necessary support to the frozen side of the work stand may be utilized.

FIGS. 10 and 11 illustrate another example of a work stand 1002. The work stand 1002 is substantially similar to the work stand 102 except that the work stand 1002 includes fixed backup rolls 1021 in place of the lower actuators 116B. In this example, the fixed backup rolls 1021 are not vertically actuated, and as such the work stand 1002 is only actuated in the direction 103. Optionally, the backup rolls 1021 are supported on a stand 1023 or other suitable support as desired. Optionally, the stand 1023 supports each backup roll 1021 at one or more locations along the backup roll 1021. In the example of FIGS. 10 and 11, three backup rolls 1021 are provided; however, in other examples, any desired number of backup rolls 1021 may be provided. In these examples, because the backup rolls 1021 are vertically fixed, the lower work roll 104B is frozen, meaning that the lower work roll 104B is constant, fixed, and/or does not move vertically against the metal substrate. In such examples, the actuation in the stand 1002 during texturing is only from one side of the stand 1002 (i.e., actuation is only from the upper side of the stand with the upper work roll 104A).

FIGS. 12 and 13 illustrate another example of a work stand 1202. The work stand 1202 is substantially similar to the work stand 102 except that the intermediate rolls and actuators are omitted, and a diameter of the lower work roll 104B is greater than the diameter of the upper work roll 104A. In this example, the work stand 1202 is only actuated in the direction 103. In some aspects, the larger diameter lower work roll 104B provides the needed support against the actuation such that the desired profile of the metal substrate 108 is created during texturing. It will be appreciated that in other examples, intermediate rolls and/or various other support rolls may be provided with the lower work roll 104B. In further examples, the lower work roll 104B may have a similar diameter as the upper work roll 104A and the work stand further includes any desired number of intermediate rolls and/or support rolls to provide the necessary support to the lower work roll 104B when one side is frozen.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A method of controlling flatness of a substrate, the method comprising: directing the substrate to a work stand of a finishing line and between a pair of vertically aligned work rolls of the work stand; applying, by a first work roll of the pair of vertically aligned work rolls, a plurality of localized pressures to the substrate across a width of the substrate, wherein each of the plurality of localized pressures is applied by a corresponding flatness control zone of the first work roll, and wherein the localized pressure applied by each flatness control zone is controlled by a corresponding actuator; measuring an actual flatness profile of the substrate with a flatness measuring device; comparing, by a controller, the actual flatness profile with a desired flatness profile; and adjusting, by the controller, the actuators such that the plurality of localized pressures modify the actual flatness profile of the substrate to achieve the desired flatness profile while an overall thickness and a length of the substrate remains substantially constant as the substrate enters and exits the work stand.

EC 2. The method of any of the preceding or subsequent examples, wherein the overall thickness of the substrate is reduced from about 0.0% to about 1.0%.

EC 3. The method of any of the preceding or subsequent examples, wherein an average of the plurality of localized pressures applied by the first work roll to the substrate is less than a yield strength of the substrate.

EC 4. The method of any of the preceding or subsequent examples, wherein adjusting the actuators comprises adjusting at least one actuator such that the localized pressure at the flatness control zone corresponding to the at least one actuator is greater than a yield strength of the substrate.

EC 5. The method of any of the preceding or subsequent examples, wherein adjusting the actuators comprises adjusting a different actuator than the at least one actuator such that the localized pressure at the flatness control zone corresponding to the different actuator is less than the yield strength of the substrate.

EC 6. The method of any of the preceding or subsequent examples, wherein adjusting the actuators comprises minimizing a difference in load between flatness control zones.

EC 7. The method of any of the preceding or subsequent examples, wherein the flatness measuring device is a multi-zone flatness measuring roll.

EC 8. The method of any of the preceding or subsequent examples, wherein the roll stack has an area moment of inertia to bending about the x-axis of from about $7.9*10^{-8}$ $m^4$ to about 0.01 $m^4$.

EC 9. The method of any of the preceding or subsequent examples, wherein the roll stack has an area moment of inertia to bending about the x-axis of from about $9.7*10^{-6}$ $m^4$ to about $1.6*10^{-4}$ $m^4$.

EC 10. The method of any of the preceding or subsequent examples, wherein the roll stack has an area moment of inertia to bending about the x-axis of from about $1.5*10^{-5}$ $m^4$ to about $1.1*10^{-4}$ $m^4$.

EC 11. The method of any of the preceding or subsequent examples, wherein the first work roll comprises an outer surface, and wherein applying the plurality of localized pressures comprises contacting the outer surface of the first work roll with a surface of the substrate.

EC 12. The method of any of the preceding or subsequent examples, wherein the outer surface of the first work roll is smooth, and wherein adjusting the actuators such that the actual flatness profile achieves the desired flatness profile further comprises smoothing a surface topography of the surface of the substrate.

EC 13. The method of any of the preceding or subsequent examples, wherein the work stand is a first work stand and the pair of vertically aligned work rolls is a first pair of vertically aligned work rolls, and wherein the method further comprises: directing the substrate to a second work stand of the finishing line and between a second pair of vertically aligned work rolls; and applying, by a first work roll of the second pair of vertically aligned work rolls, a plurality of localized pressures to the substrate across the width of the substrate, wherein each localized pressure is applied by a corresponding flatness control zone of the first work roll of the second pair of vertically aligned work rolls, wherein the load applied by each flatness control zone is controlled by a corresponding actuator, wherein an outer surface of the first work roll of the second pair of vertically aligned work rolls comprises a texture, and wherein applying the plurality of localized pressures by the first work roll of the second pair of vertically aligned work rolls comprises texturing the surface of the substrate such that the overall thickness and the length of the substrate remain substantially constant when the substrate exits the second work stand.

EC 14. The method of any of the preceding or subsequent examples, wherein the outer surface of the first work roll comprises a texture, and wherein adjusting the actuators such that the actual flatness profile achieves the desired flatness profile further comprises applying the texture to the surface of the substrate.

EC 15. The method of any of the preceding or subsequent examples, wherein the surface of the substrate comprises a surface roughness, wherein the outer surface of the first work roll comprises approximately the same surface roughness, and wherein the surface roughness is from about 0.4 μm to about 6.0 μm.

EC 16. The method of any of the preceding or subsequent examples, wherein the surface roughness is from about 0.7 μm to about 1.3 μm.

EC 17. The method of any of the preceding or subsequent examples, wherein measuring the actual flatness profile comprises determining regions on the substrate with tensile residual stress and regions on the substrate with compressive residual stress, and wherein adjusting the actuators comprises increasing the localized pressures of flatness control zones corresponding to the regions of tensile residual stress.

EC 18. The method of any of the preceding or subsequent examples, wherein increasing the localized pressures of flatness control zones corresponding to the regions of tensile residual stress comprises applying localized pressures that cause a localized elongation of from about 0.0% to about 1.0%.

EC 19. The method of any of the preceding or subsequent examples, wherein increasing the localized pressures of flatness control zones corresponding to the regions of tensile residual stress comprises applying localized pressures that cause a localized elongation of from about 0.0% to about 0.2%.

EC 20. The method of any of the preceding or subsequent examples, wherein increasing the localized pressures of flatness control zones corresponding to the regions of tensile residual stress comprises applying localized pressures that cause a localized elongation of about 0.1%.

EC 21. A flatness control system comprising: a work stand of a finishing line comprising a pair of vertically aligned work rolls, wherein a first work roll of the pair of vertically aligned work rolls comprises a plurality of flatness control zones across a width of the first work roll, and wherein each flatness control zone is configured to apply a localized pressure to a corresponding region on a substrate; a plurality of actuators, wherein each actuator corresponds with one of the plurality of flatness control zones and is configured to cause the corresponding flatness control zone to apply the localized pressure to the corresponding region on the substrate; a flatness measuring device configured to measure an actual flatness profile of the substrate; and a controller configured to adjust the plurality of actuators such that the localized pressures modify the actual flatness profile to achieve a desired flatness profile while an overall thickness and a length of the substrate remains substantially constant when the substrate exits the work stand.

EC 22. The flatness control system of any of the preceding or subsequent examples, wherein each actuator is individually controlled by the controller.

EC 23. The flatness control system of any of the preceding or subsequent examples, wherein a plurality of actuators are controlled concurrently by the controller.

EC 24. The flatness control system of any of the preceding or subsequent examples, wherein an average of the localized pressures applied by the first work roll to the substrate is less than a yield strength of the substrate.

EC 25. The flatness control system of any of the preceding or subsequent examples, wherein the controller is configured to adjust at least one actuator such that the localized pressure at the flatness control zone corresponding to the at least one actuator is greater than a yield strength of the substrate.

EC 26. The flatness control system of any of the preceding or subsequent examples, wherein the controller is configured to adjust a different actuator than the at least one actuator such that the localized pressure at the flatness control zone corresponding to the different actuator is less than the yield strength of the substrate.

EC 27. The flatness control system of any of the preceding or subsequent examples, wherein the controller is configured to minimize a difference in load between flatness control zones.

EC 28. The flatness control system of any of the preceding or subsequent examples, wherein the flatness measuring device is a multi-zone flatness measuring roll.

EC 29. The flatness control system of any of the preceding or subsequent examples, wherein the roll stack has an area moment of inertia to bending about the x-axis of from about $7.9*10^{-8}$ $m^4$ to about 0.01 $m^4$.

EC 30. The flatness control system of any of the preceding or subsequent examples, wherein the roll stack has an area moment of inertia to bending about the x-axis of from about $9.7*10^{-6}$ $m^4$ to about $1.6*10^{-4}$ $m^4$.

EC 31. The flatness control system of any of the preceding or subsequent examples, wherein the roll stack has an area moment of inertia to bending about the x-axis of from about $1.5*10^{-5}$ $m^4$ to about $1.1*10^{-4}$ $m^4$.

EC 32. The flatness control system of any of the preceding or subsequent examples, wherein the first work roll comprises an outer surface configured to contact a surface of the substrate during processing.

EC 33. The flatness control system of any of the preceding or subsequent examples, wherein the outer surface of the first work roll is smooth having a surface roughness lower than about 0.4-0.6 μm, and wherein the first work roll is configured to smooth a surface topography of the surface of the substrate.

EC 34. The flatness control system of any of the preceding or subsequent examples, wherein the work stand is a first work stand and the pair of vertically aligned work rolls is a first pair of work rolls, and wherein the flatness control system further comprises: a second work stand of the finishing line comprising a second pair of vertically aligned work rolls, wherein a first work roll of the second pair of vertically aligned work rolls comprises a plurality of flatness control zones across the width of the first work roll of the second pair of work rolls, and wherein each flatness control zone is configured to apply a localized pressure to a corresponding region on a substrate, wherein the load applied by each flatness control zone of the first work roll of the second pair of vertically aligned work rolls is controlled by a corresponding actuator, wherein an outer surface of the first work roll of the second pair of vertically aligned work rolls comprises a texture, and wherein the first work roll of the second pair of work rolls is configured to texture the surface of the substrate such that the overall thickness and the length of the substrate remain substantially constant when the substrate exits the second work stand.

EC 35. The flatness control system of any of the preceding or subsequent examples, wherein the outer surface of the first work roll comprises a texture, and wherein the first work roll is configured to apply the texture to the surface of the substrate.

EC 36. The flatness control system of any of the preceding or subsequent examples, wherein the surface of the substrate comprises a surface roughness, wherein the outer surface of the first work roll comprises approximately the same surface roughness, and wherein the surface roughness is from about 0.4 μm to about 6.0 μm.

EC 37. The flatness control system of any of the preceding or subsequent examples, wherein surface roughness is from about 0.7 μm to about 1.3 μm.

EC 38. The flatness control system of any of the preceding or subsequent examples, wherein the flatness measuring device is configured to determine regions on the substrate with tensile residual stress and regions on the substrate with compressive residual stress, and wherein the controller is configured to adjust the actuators to increase the localized pressures of flatness control zones corresponding to the regions of tensile residual stress.

EC 39. The flatness control system of any of the preceding or subsequent examples, wherein the controller is configured to adjust the actuators such that the localized pressures of flatness control zones corresponding to the regions of tensile residual stress cause a localized elongation of from about 0.0% to about 1.0%.

EC 40. The flatness control system of any of the preceding or subsequent examples, wherein the controller is configured to adjust the actuators such that the localized pressures of flatness control zones corresponding to the regions of tensile residual stress cause a localized elongation of from about 0.0% to about 0.2%.

EC 41. The flatness control system of any of the preceding or subsequent examples, wherein the controller is configured to adjust the actuators such that the localized pressures of flatness control zones corresponding to the regions of tensile residual stress cause a localized elongation of about 0.1%.

EC 42. The flatness control system or method of any of the preceding or subsequent example combinations, wherein applying the plurality of localized pressures to the substrate with the first work roll comprises freezing a vertical position of a second work roll vertically aligned with the first work roll.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A method of controlling flatness of a substrate, the method comprising:

directing the substrate to a work stand of a finishing line and between a pair of vertically aligned work rolls of the work stand;

applying, by a first work roll of the pair of vertically aligned work rolls, a plurality of localized pressures to the substrate across a width of the substrate, wherein each of the plurality of localized pressures is applied by a corresponding flatness control zone of the first work roll, and wherein the localized pressure applied by each flatness control zone is controlled by a corresponding actuator, wherein the actuators comprise at least an edge actuator for controlling an edge region of the substrate and at least a non-edge actuator for controlling a non-edge region of the substrate, wherein at least one physical characteristic of the edge actuator is different from the non-edge actuator and causes a different localized pressure compared to the localized pressure of the non-edge actuator;

measuring an actual flatness profile of the substrate with a flatness measuring device;

comparing, by a controller, the actual flatness profile with a desired flatness profile; and adjusting, by the controller, each of the actuators independently from one another such that the plurality of localized pressures modify the actual flatness profile of the substrate to achieve the desired flatness profile while an overall thickness and a length of the substrate remains substantially constant as the substrate enters and exits the work stand so that the overall thickness of the substrate is reduced from 0.0% to 1.0% and so that the work roll pressures applied to the substrate by the work rolls cause the length of the substrate to increase between 0.0% and 1.0%, wherein adjusting each actuator comprises adjusting each actuator to control each corresponding flatness control zone to apply the corresponding localized pressure that, for each flatness control zone, causes a localized elongation of a corresponding portion of the substrate, and wherein the first work roll comprises an outer surface, and wherein applying the plurality of localized pressures comprises contacting the outer surface of the first work roll with a surface of the substrate.

2. The method of claim 1, wherein an average of the plurality of localized pressures applied by the first work roll to the substrate is less than a yield strength of the substrate.

3. The method of claim 1, wherein adjusting the actuators comprises adjusting at least one actuator such that the localized pressure at the flatness control zone corresponding to the at least one actuator is greater than a yield strength of the substrate.

4. The method of claim 3, wherein adjusting the actuators comprises adjusting a different actuator than the at least one actuator such that the localized pressure at the flatness control zone corresponding to the different actuator is less than the yield strength of the substrate.

5. The method of claim 1, wherein applying the plurality of localized pressures to the substrate with the first work roll comprises freezing a vertical position of a second work roll vertically aligned with the first work roll.

6. The method of claim 1, wherein the outer surface of the first work roll is smooth, and wherein adjusting the actuators such that the actual flatness profile achieves the desired flatness profile further comprises smoothing a surface topography of the surface of the substrate.

7. The method of claim 1, wherein the outer surface of the first work roll comprises a texture, and wherein adjusting the actuators such that the actual flatness profile achieves the desired flatness profile further comprises applying the texture to the surface of the substrate.

8. The method of claim 1, wherein measuring the actual flatness profile comprises determining regions on the substrate with tensile residual stress and regions on the substrate with compressive residual stress, and wherein adjusting the actuators comprises increasing the localized pressures of flatness control zones corresponding to the regions of tensile residual stress.

9. The method of claim 8, wherein increasing the localized pressures of flatness control zones corresponding to the regions of tensile residual stress comprises applying localized pressures that cause a localized elongation of from greater than 0.0% to 1.0%.

10. A flatness control system comprising:

a work stand of a finishing line comprising a pair of vertically aligned work rolls, wherein a first work roll of the pair of vertically aligned work rolls comprises a plurality of flatness control zones across a width of the first work roll, and wherein each flatness control zone is configured to apply a localized pressure to a corresponding region on a substrate, wherein the first work roll comprises an outer surface that is configured to contact a substrate during processing;

a plurality of actuators, wherein each actuator corresponds with one of the plurality of flatness control zones and is configured to cause the corresponding flatness control zone to apply the localized pressure to the corresponding region on the substrate by contacting the outer surface of the first work roll with the surface of the substrate, and wherein each actuator is independently controlled, wherein the plurality of actuators comprises at least an edge actuator for controlling an edge region of the substrate and at least a non-edge actuator for controlling a non-edge region of the substrate, wherein at least one physical characteristic of the edge actuator is different from the non-edge actuator and causing a different localized pressure compared to the localized pressure of the non-edge actuator;

a flatness measuring device configured to measure an actual flatness profile of the substrate; and a controller configured to adjust each actuator of the plurality of actuators independently from one another such that the localized pressures modify the actual flatness profile to achieve a desired flatness profile while an overall thickness and a length of the substrate remains substantially constant when the substrate exits the work stand and such that the localized pressures cause a localized elongation of a plurality of portions of the substrate so that the overall thickness of the substrate is reduced from 0.0% to 1.0% and so that the work roll pressures applied to the substrate by the work rolls cause the length of the substrate to increase between 0.0% and 1.0%, each portion of the substrate corresponding to a particular flatness control zone of the plurality of flatness control zones.

11. The flatness control system of claim 10, wherein an average of the localized pressures applied by the first work roll to the substrate is less than a yield strength of the substrate.

12. The flatness control system of claim 10, wherein the controller is configured to adjust at least one actuator such that the localized pressure at the flatness control zone corresponding to the at least one actuator is greater than a yield strength of the substrate.

13. The flatness control system of claim 12, wherein the controller is configured to adjust a different actuator than the at least one actuator such that the localized pressure at the flatness control zone corresponding to the different actuator is less than the yield strength of the substrate.

14. The flatness control system of claim 10, wherein the controller is configured to minimize a difference in load between flatness control zones.

15. The flatness control system of claim 10, wherein the outer surface of the first work roll is smooth having a surface roughness of 0.4-0.6 μm, and wherein the first work roll is configured to smooth a surface topography of the surface of the substrate.

16. The flatness control system of claim 10, wherein the outer surface of the first work roll comprises a texture, and wherein the first work roll is configured to apply the texture to the surface of the substrate.

17. The flatness control system of claim 10, wherein the flatness measuring device is configured to determine regions on the substrate with tensile residual stress and regions on the substrate with compressive residual stress, and wherein the controller is configured to adjust the actuators to increase the localized pressures of flatness control zones corresponding to the regions of tensile residual stress.

18. The method of claim 1, wherein the at least one physical characteristic comprises at least one of a crown of the edge actuator, a diameter of the edge actuator, or a width of the edge actuator.

19. The flatness control system of claim 10, wherein the at least one physical characteristic comprises at least one of a crown of the edge actuator, a diameter of the edge actuator, or a width of the edge actuator.

* * * * *